United States Patent [19]

Stalker et al.

[11] 3,963,367

[45] June 15, 1976

[54] TURBINE SURGE DETECTION SYSTEM

[75] Inventors: Robert W. Stalker; Bernard Blutinger, both of San Diego, Calif.

[73] Assignee: International Harvester Company, San Diego, Calif.

[22] Filed: Aug. 21, 1974

[21] Appl. No.: 499,353

[52] U.S. Cl. ..... 415/17; 415/1; 417/15; 417/42

[51] Int. Cl.[2] ..... F04D 15/02

[58] Field of Search ..... 415/1, 17, 18, 36; 417/15, 42, 43, 44

[56] References Cited

UNITED STATES PATENTS

| | | | |
|---|---|---|---|
| 1,419,316 | 6/1922 | Shebondy | 417/43 |
| 1,451,064 | 4/1923 | Dunajeff | 417/42 |
| 2,317,135 | 4/1943 | Crittenden et al. | 417/42 |
| 2,478,423 | 8/1949 | Ponomaref et al. | 415/17 |
| 2,651,995 | 9/1953 | Blackburn | 417/44 |
| 3,238,376 | 3/1966 | Ernst et al. | 415/17 |
| 3,240,422 | 3/1966 | Pettersen et al. | 415/13 |
| 3,292,845 | 12/1966 | Hens et al. | 415/17 |
| 3,292,846 | 12/1966 | Harper et al. | 415/17 |
| 3,671,134 | 6/1972 | Boothe | 415/13 |
| 3,744,925 | 7/1973 | Kraemer | 415/17 |

*Primary Examiner*—C. J. Husar
*Attorney, Agent, or Firm*—Matthew P. Lynch

[57] ABSTRACT

A system for detecting turbine compressor surge wherein a transducer produces a signal in response to discharge pressure fluctuations and depending upon the magnitude and frequency of the signals the compressor flow and pressure rise is regulated.

10 Claims, 4 Drawing Figures

TURBINE SURGE DETECTION SYSTEM

BACKGROUND OF THE INVENTION

Centrifugal turbine compressors have been used for many years to raise the pressure of natural gas or other compressible fluids in pipelines. By increasing the pipeline pressure of such fluids a corresponding increase in the mass flowrate of the fluid through the pipeline occurs, resulting in a greater quantity of fluid being delivered to its desired destination within a shorter period of time than would occur at lower pressure values.

It is generally known that a given compressor has a unique operating relationship to the pressure and flowrate of the compressible fluid. This relationship depends, to a large extent, on the internal staging and geometry of the compressor. However, all centrifugal compressors follow a general performance pattern. For a fixed operating speed, the flowrate of the fluid being compressed will decrease as the head pressure or pressure rise through the compressor increases. A compressor will operate in this fashion until it reaches its surge limit. The surge limit is reached when the compressor stalls producing a flow reversal of the fluid being compressed. Operation of the compressor as near as possible to the surge limit, at a fixed compressor speed, is highly desirable because at the surge limit the pressure of the fluid is maximum and, consequently, compressor operation is maximally efficient.

This previously described flow reversal produces a small decrease in the fluid discharge pressure of the compressor. As a result of the decrease in compressor discharge pressure, the fluid flowrate increases, thereby causing an increase in the compressor speed. As a result, the compressor is forced back to its former fixed operating speed. The compressor will maintain its previous fixed operating speed until the pressure of the compressed fluid, once again, rises to the surge limit, after which the entire process, as previously described, is repeated.

This cyclic instability is simply referred to as surge. The frequency of its occurrence as the compressor is operated near the surge limit will typically vary from one-half a cycle to five cycles per second.

Initially, these flow reverses are harmless because of their reduced magnitude and low frequency of occurrence. However, as the magnitude and frequency of the flow reversals increase, the effect upon the compressor being operated close to the surge limit is destructive. When such a surge condition occurs, it produces concurrent axial displacements of the compressor rotor and the rotor shaft. These rapid axial displacements of the rotor shaft cause the shaft to oscillate back and forth between the rotor shaft bearings until the bearings are damaged. Once rotor bearing failure occurs, rotation of the rotor ceases and the compressor is rendered inoperative.

Consequently, in order to operate the compressor as efficiently as possible while avoiding destruction of the compressor assembly, it is necessary to monitor the various operational parameters of the compressor, such as compressor discharge pressure or compressor discharge temperature, to determine when the surge limit of the compressor has been reached.

One method employed in the prior art to detect the surge limit was to select an orifice, the size of which is determined by the known flow-pressure characteristics of the compressor to be monitored, and to insert this orifice into the fluid flow stream. Then, by measuring the fluid pressure differential measuring the fluid pressure differential across the orifice, the actual flowrate in the system could be determined using the well-known mathematical relationship established by Bernoulli between fluid pressure and flowrate.

However, this method is undesirable for a number of reasons. One reason is that the placement of an orifice directly in the fluid flow stream produces a pressure drop in the pipeline and reduces fluid flowrate. The effect is a reduction in the over-all efficiency of the function of the compressor-pipeline system. Another reason is that the introduction of such an orifice into the fluid flow stream creates an artificial compressor surge limit. One effect of such an artificial surge limit is to lower the maximum fluid pressure obtainable at a fixed compressor operating speed. Further, because it is an artificial, rather than the actual surge limit of the compressor, subsequent changes in the pipeline and compressor operating conditions can render the system useless by causing the artificial surge limit to shift, necessitating an expensive re-evaluation of the system's operating conditions.

Another method measures the compressor's fluid discharge temperature. However, this method is undesirable because it requires expensive electronic equipment and is highly sensitive to the deleterious effects of cavitation caused by the immersion of the temperature sensor in the fluid flowstream. Such fluid immersion not only results in a short life-expectancy for the temperature sensor but also typically produces inaccuracies due to the rapidly changing nature of the fluid and the flow conditions.

SUMMARY OF THE INVENTION AND OBJECTS

Briefly stated, the turbine compressor stall detection system comprises compressor discharge pressure sensing means, signal amplifier means, signal detecting means, pulse counting means, and utilization means.

The compressor discharge pressure sensing means, basically, comprises a pressure transducer which produces a voltage output, proportional to the magnitude of the compressor discharge pressure and in substantial synchronization with the fluctuations thereof. The voltage output of the compressor discharge sensing means is coupled to the signal detecting means. The signal detecting means produces an output pulse when the voltage of the output of the compressor discharge sensing means exceeds a predetermined value.

A pulse counting means coupled to the signal detecting means counts the number of pulses received from the signal detecting means. Finally, the utilization means, which is operatively coupled to the detecting means, is responsive to a predetermined number of pulses from the detector means within a predetermined time period to effectuate a control output which is an indication of compressor surge.

It is, therefore, an important object of the present invention to provide a new and novel method of detecting compressor surge or stall in a centrifugal compressor.

Another important object of the present invention is to prevent the damage and costly repairs which are typically incurred by the compressor when operated for an excessive period of time in a surge condition.

Still another important object of the present invention is to provide a compressor surge detecting system which is low in cost.

Yet another object of the present invention is to provide a means for detecting and indicating compressor surge without effecting over-all operation of the compressor-pipeline fluid flow system.

Another important object of the present invention is to provide a means for improving both the operating pressure range of the compressor and its installed operating efficiency.

The novel features which are characteristics of this invention are set forth with particularity in the appended claims. The invention itself, however, as to its organization, together with further objects and advantages, may be understood by reference to the following description of a compressor surge detection system taken in conjunction with the accompanying drawings and description.

DESCRIPTION OF THE PREFERRED EMBODIMENT

Figure 1:
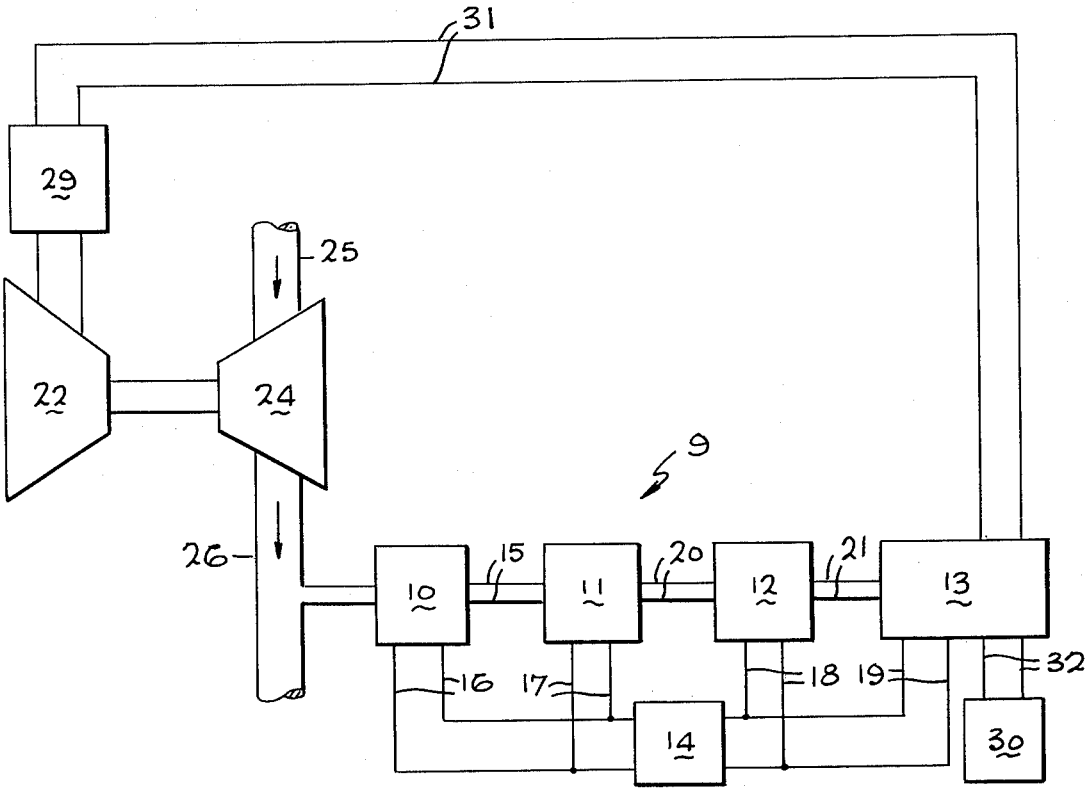
FIG. 1 illustrates a compressor surge detector system which is constructed in accordance with the present invention and incorporates control of prime mover speed to control compressor speed.
Figure 4:
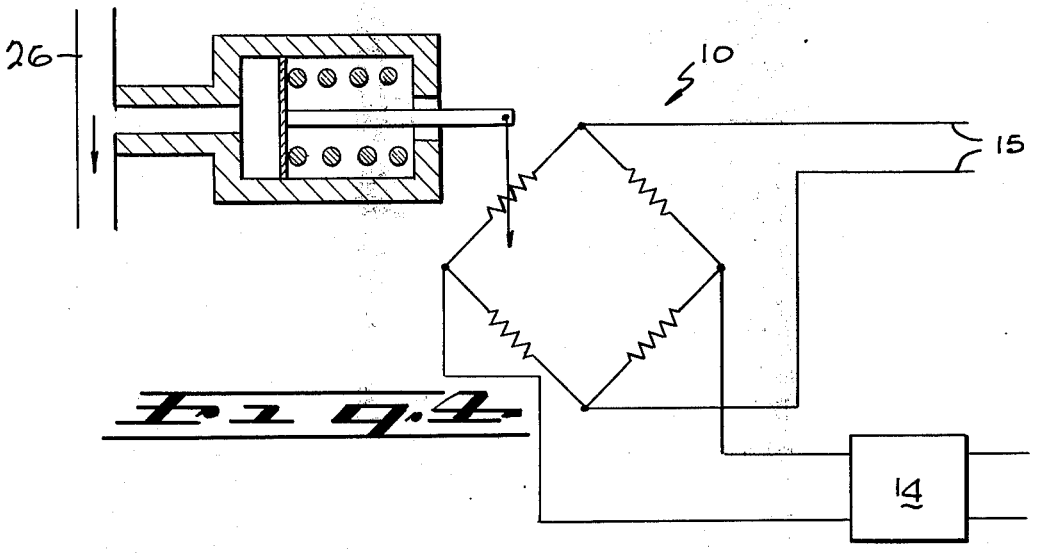
FIG. 4 illustrates a preferred embodiment of the pressure surge sensing device.

Referring to FIG. 1, a compressor surge detection system, generally indicated at 9, is shown which comprises a pressure sensing means 10, a signal detector means 11, a pulse counter means 12, a signal utilization means 13, and a DC power supply 14. Pressure sensing means 10 typically consists of a pressure transducer with four low-impedance elements electrically connected as a Wheatstone Bridge, with one of the four low-impedance elements mechanically coupled to a pressure responsive diaphragm element (see FIG. 4). The pressure sensing means 10 is typically connected by conductors 16 to a DC power supply 14. When the diaphragm is exposed to a pressure or a pressure variation, the electrical balance of the Wheatstone Bridge connected elements is changed, thereby producing an electrical signal. Typically, the magnitude of the electrical signal produced is directly proportional to the magnitude of the pressure or pressure change.

The electrical signal output of the pressure sensing means 10 is input to the signal detector means 11 via conductors 15. The signal detector means 11 connected to the DC power supply 14 by conductors 17 generally consists of an electrical circuit, such as the well known Schmidt trigger circuit, which, when input with an electrical signal having a predetermined magnitude, will produce an electrical pulse at the output thereof. Since the signal detector means 11 is responsive only to an electrical signal having a predetermined magnitude, spurious signals, such as noise, which are not indicative of the pressure sensed by the pressure sensing means 10, do not cause the signal detector means 11 to generate an output pulse.

The onput pulses of the signal detector means 11 are input to the pulse counter means 12 via the conductors 20. The pulse counter means 12 is connected to the DC power supply 14 by conductors 18. Pulse counter means 12 produces an output signal only when a predetermined number of pulses are received from the signal detector means 11 within a predetermined period of time.

Signal utilization means 13 is connected to the pulse counter means 12 by conductors 21 and to the DC power supply 14 via conductors 19. Upon receiving an output signal from the pulse counter means 12, the signal utilization means 13 responds by causing an "open-close" interval switching means, such as a relay, silicon controlled rectifier circuit or a transistor circuit to be activated.

Figure 2:
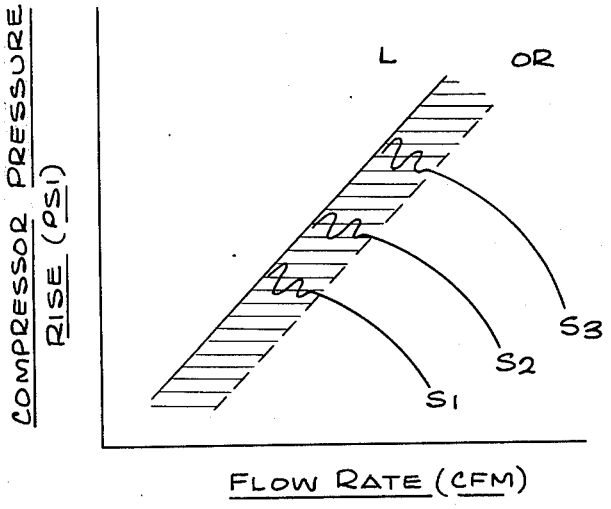
FIG. 2 is a graph illustrating the operating region of a compressor stall detector system constructed in accordance with this invention.

Referring now to FIG. 2, a graph plotting the compressor pressure rise, in pounds per square inch (PSI), against the fluid flowrate, in cubic feet per minute (CFM) is illustrated. A family of compressor speeds, along lines of constant speed $S_1$, $S_2$ and $S_3$, appears on the graph as a function of both compressor pressure rise and fluid flowrate.

As shown in the graph of FIG. 2, as the compressor pressure rise increases, the flow decreases for a constant operating speed, $S_1$. The compressor will function in this manner until it nears the point at which a fluid flow reversal occurs. This flow reversal occurs at a point in the graph, which when determined for each line of constant operating speed and interconnected by a line, is referred to as the surge limit, L. This flow reversal causes a decrease in the compressor discharge pressure. The decrease in the compressor discharge pressure allows the compressor speed to increase, returning the compressor speed to its previous value along a constant speed line, S. Once this occurs, while the compressor is at its surge limit, the entire process, as previously described, is repeated. This cyclic instability will typically vary from one-half of a cycle to five cycles per second.

Initially, these flow reversals are harmless because of their reduced magnitude and low frequency of occurrence. However, as the magnitude and frequency of the flow reversals increase, their effects upon the compressor which is operated close to the surge limit is destructive. When such a surge condition occurs, it produces corresponding axial displacements of the compressor rotor and the rotor shaft. These rapid axial displacements of the rotor shaft cause the shaft to oscillate back and forth between the rotor shaft bearings until the bearings are damaged. Once rotor bearing failure occurs, rotation of the rotor ceases and the compressor is rendered inoperative.

Since these compressor discharge pressure pulses are indicative of compressor surge, continued measurements and investigation led to the discovery that continuous harmful compressor surge, requiring immediate correction, occurred when three pulses in excess of 8 to 10 percent of the value of compressor discharge pressure occurred in less than five seconds.

By monitoring and counting the compressor discharge pressure fluctuations, corrective action could be effected to prevent compressor damage.

Recalling that, for a constant comprssor speed, compressor discharge pressure is maximum at the surge limit, that maximum compressor operating efficiency also occurs at the surge limit. Consequently, by precisely determining surge limit for the compressor and operating the compresor near the surge limit, improved performance and efficiency of the compressor can be obtained.

With continued reference to FIG. 1, there is shown and illustrated, in addition to the compressor surge detection system as hereinbefore described, a driver means 22, coupled by a mechanical linkage, such as a shaft 23, to a compressor 24 having a fluid suction pipeline 25 for delivering compressible fluid to the compressor 24 and a fluid discharge pipeline 26 for receiving the compressed fluid from the compressor 24.

The compressor surge detector system 9, as previously described, is operatively coupled to the compressor discharge pipeline 26 by coupling the pressure receiving port of the pressure sensing means 10 to the inside of the compressor discharge pipeline 26 where it is exposed to the pressure of the compressor discharge.

Figure 3:
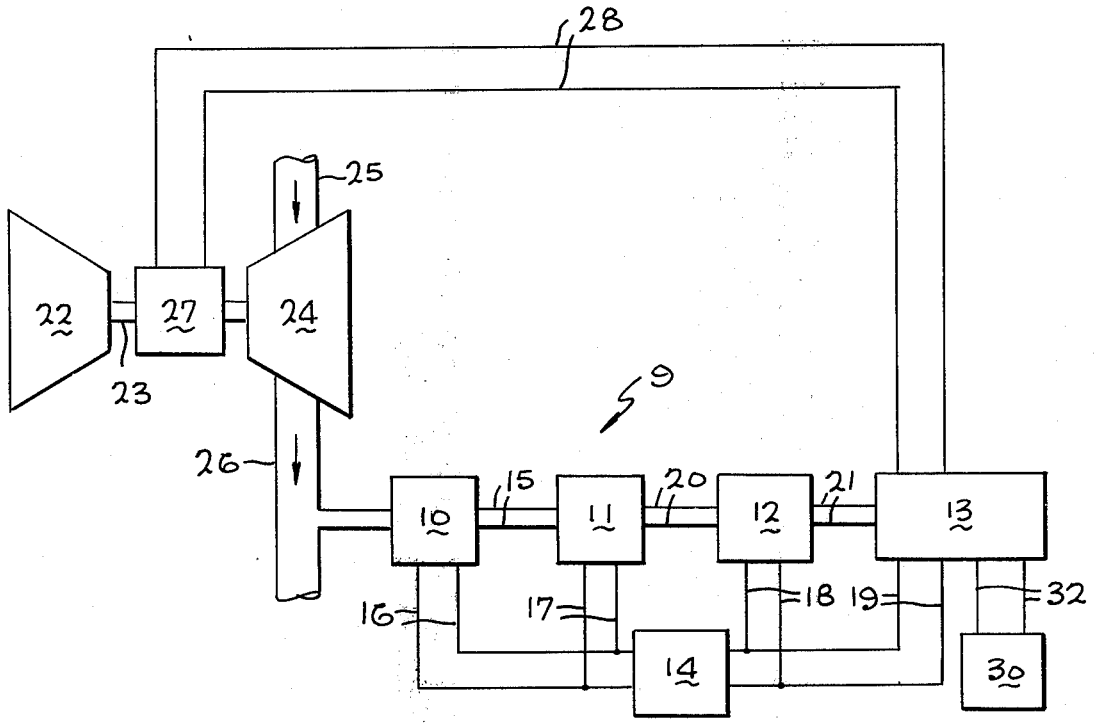
FIG. 3 illustrates a compressor surge detector system which controls compressor speed by declutching the compressor from the prime mover.

As the pressure increases, the magnitude of the voltage output of the pressure sensing means 10 being directly proportional to the magnitude of the pressure sensed by the pressure sensing means 10, increases. When flow reversal or surge occurs, a variation in the magnitude of the compressor discharge pressure varies, causing the pressure sensor means 10 to produce a variation in the magnitude of its output signal which is indicative of the magnitude and frequency of the pressure change. In the event that the pressure sensing means output signal indicates a pressure value of from 8 to 10 percent of the value of the compressor discharge pressure, the signal detector means 11 will generate a pulse which is input to the pulse counter means 12 and is counted. Should the pulse counter means 12 receive three of these pulses from the signal detector means 11 within less than five seconds, it generates a signal which is input to the signal utilization means 13, which causes an internal switch to be activated or an indicator 30, such as a meter connected to the signal utilization means 13 by conductors 32 to be activated to initiate surge corrective activities such as (see FIG. 3) shutdown of the driver means 22 by disengaging the shaft 23 from the compressor 24 by activation of an electro-magnetic clutch means 27 controlled by signal utilization means 13 connected thereto via conductors 28.

Another method for correcting compressor surge (see FIG. 1) is to incrementally decrease the compressor flow and pressure rise by reducing compressor speed. Compressor speed is controlled by driver means 22 via the shaft 23. The speed of the driver means 22, in turn, is controlled by driver speed control means 29 connected to signal utilization means 13 by conductors 31, which may take a variety of forms depending on the nature of the driver means 22. If the driver means 22 is an internal combustion device, the speed control means 29 can be a carburetor having an electromechanically-positioned throttle linkage. If the driver means 22 is an electrically driven device, then its speed may be controlled by a voltage level or phase controller, depending on the precise nature of the electrical device.

Basically, the signal utilization means 13 is directed to prevent harmful compressor surge by applying its output to any circuit in the compressor electric control system which will cause the operation of the compressor to change to eliminate compressor surge effects.

While the present invention has been described with reference to a particular system for a particular purpose, various modifications may be made by those skilled in the art without actually departing from the spirit and scope of the invention.

What I claim as new and desire to secure by Letters Patent of the United States of America is:

1. A gas compressor surge detector system, comprising:

compressor discharge pressure sensing means for connection to a compressor output line for produceing a signal responsive to the magnitude of said discharge pressure;

signal detecting means coupled to said pressure sensing means for producing an electrical output pulse when the magnitude of said signal exceeds a predetermined value;

pulse counting means coupled to said signal detecting means for counting the pulse rate and for producing an output signal in response to receiving a predetermined number of pulses within a given period of time from said signal detecting means; and signal utilization means coupled to said pulse counting means for emitting a control signal in response to the output signal from said pulse counting means.

2. The surge detection system of claim 1, wherein said pressure sensing means comprises a pressure transducer for producing a voltage output proportional to the magnitude of the compressor discharge pressure and in substantial synchronization with the fluctuations thereof.

3. The surge detection system of claim 2, wherein said pressure sensing means comprises:

at least four resistive elements, said elements being connected as a Wheatstone Bridge;

a diaphragm exposed to the discharge pressure and connected to at least one of said resistive elements for producing a variation in the impedance of said connected resistive elements in proportion to diaphram movement which has been produced in response to variations in discharge pressure; and a D.C. power supply connected to said resistive elements.

4. The surge detection system of claim 1, wherein said signal detecting means is responsive to the output signal of said pressure sensing means when said signal exceeds eight percent of the value of the compressor discharge pressure.

5. The surge detection system of claim 1, wherein said pulse counting means generates an output signal when said signal detecting means inputs to said pulse counting means at least three pulses within a given period of time.

6. The surge detection system of claim 5, wherein said given period of time is five seconds.

7. The surge detection system of claim 1, wherein said signal utilization means includes means for disconnecting said compressor from its driving means in response to the output signal from said pulse counting means.

8. The surge detection system of claim 1, wherein said signal utilization means includes means to incrementally decrease the compressor flow and pressure rise in response to the output signal from said pulse counting means.

9. The surge detection system of claim 1, wherein said signal utilization means includes means for reducing compressor speed in response to the output signal from said pulse counting means.

10. The compressor surge detection system of claim 1, wherein said signal utilization means includes an indicator.

* * * * *